US010745179B2

(12) United States Patent
Levy et al.

(10) Patent No.: US 10,745,179 B2
(45) **Date of Patent: *Aug. 18, 2020**

(54) TRAVEL BOTTLE WITH SLIDE OR ROTATABLE LOCK

(71) Applicant: Navajo Manufacturing Company, Inc., Denver, CO (US)

(72) Inventors: Gordon Levy, Golden, CO (US); Shawn A. Shelton, Highlands Ranch, CO (US)

(73) Assignee: Navajo Manufacturing Company, Inc., Denver, CO (US)

( * ) Notice: Subject to any disclaimer, the term of this patent is extended or adjusted under 35 U.S.C. 154(b) by 93 days.

This patent is subject to a terminal disclaimer.

(21) Appl. No.: 16/123,578

(22) Filed: Sep. 6, 2018

(65) Prior Publication Data

US 2019/0256259 A1 Aug. 22, 2019

Related U.S. Application Data

(63) Continuation-in-part of application No. 15/900,085, filed on Feb. 20, 2018.

(60) Provisional application No. 62/686,724, filed on Jun. 19, 2018.

(51) Int. Cl.

| | |
|---|---|
| ***B65D 50/04*** | (2006.01) |
| ***B65D 47/08*** | (2006.01) |
| ***B65D 47/28*** | (2006.01) |
| ***B65D 47/26*** | (2006.01) |

(52) U.S. Cl.

CPC ..... *B65D 50/045* (2013.01); *B65D 47/0809* (2013.01); *B65D 47/0842* (2013.01); *B65D 47/265* (2013.01); *B65D 47/286* (2013.01); *B65D 2251/1008* (2013.01); *B65D 2251/1025* (2013.01)

(58) Field of Classification Search

CPC ..... B65D 41/62; B65D 51/18; B65D 47/066; B65D 47/08; B65D 2251/1025; B65D 50/045; B65D 47/0809; B65D 47/0842

USPC ..... 220/259.3

See application file for complete search history.

(56) References Cited

U.S. PATENT DOCUMENTS

| | | | |
|---|---|---|---|
| 2,582,360 | A | 1/1952 | Sheridan |
| 3,094,255 | A | 6/1963 | Hunter |
| 3,358,890 | A | 12/1967 | Dalfo |
| 3,460,719 | A | 8/1969 | O'Donnell et al. |
| 3,484,023 | A | 12/1969 | Meshberg |
| 3,655,099 | A | 4/1972 | Hazard |
| 3,702,165 | A | 11/1972 | Carrow et al. |
| 3,784,060 | A | 1/1974 | Hazard |
| 3,847,313 | A | 11/1974 | Micallef |
| 3,848,778 | A | 11/1974 | Meshberg |
| 3,873,005 | A | 3/1975 | Hazard |
| 3,874,568 | A | 4/1975 | La Vange et al. |
| 4,047,643 | A | 9/1977 | Hazard |
| 4,081,113 | A | 3/1978 | Hazard |
| 4,299,339 | A | 11/1981 | Giroux et al. |
| 4,487,342 | A | 12/1984 | Shy |
| 4,500,016 | A | 2/1985 | Funfstuck |

(Continued)

*Primary Examiner* — Shawn M Braden

(74) *Attorney, Agent, or Firm* — Studebaker & Brackett PC

(57) ABSTRACT

A bottle includes a secure sealing mechanism. A slide switch plate or rotatable plate maintains the contents of the bottle. This is achieved by securing a dispensing mechanism in a closed, locked position and sealing an outlet so that any liquids are prevented from exiting the bottle.

19 Claims, 16 Drawing Sheets

(56) References Cited

U.S. PATENT DOCUMENTS

| | | | | | |
|---|---|---|---|---|---|
| 4,542,837 | A | | 9/1985 | Rayner | |
| 4,591,079 | A | | 5/1986 | Bigotte | |
| 4,645,086 | A | | 2/1987 | Rosenthal | |
| 4,776,501 | A | | 10/1988 | Ostrowsky | |
| 4,779,773 | A | | 10/1988 | Bennett | |
| 4,852,770 | A | * | 8/1989 | Sledge | B65D 47/0814 222/153.14 |
| 4,962,869 | A | | 10/1990 | Gross et al. | |
| 5,141,129 | A | | 8/1992 | Jennings | |
| 5,284,264 | A | | 2/1994 | Gross | |
| 5,314,093 | A | | 5/1994 | Gross et al. | |
| 5,573,127 | A | * | 11/1996 | Takahashi | B65D 47/0814 215/237 |
| 5,622,284 | A | | 4/1997 | Sawicki | |
| 5,649,645 | A | | 7/1997 | Demarest et al. | |
| 6,283,333 | B1 | | 9/2001 | Knickerbocker et al. | |
| 6,896,160 | B2 | | 5/2005 | Kaufman et al. | |
| 6,971,547 | B2 | | 12/2005 | Englert et al. | |
| 7,328,820 | B2 | * | 2/2008 | Young | B65D 47/0838 215/235 |
| 8,251,263 | B2 | * | 8/2012 | Demarco | B65D 51/18 220/253 |
| 8,622,229 | B2 | * | 1/2014 | Lane | B65D 43/26 215/245 |
| 9,382,059 | B2 | | 7/2016 | Selinger et al. | |
| 2003/0038146 | A1 | | 2/2003 | Meshberg | |
| 2004/0112927 | A1 | | 6/2004 | Kaufman et al. | |
| 2015/0173539 | A1 | * | 6/2015 | Mason | B65D 47/063 220/707 |
| 2016/0016703 | A1 | * | 1/2016 | Muhlemann | B65D 41/62 222/566 |

* cited by examiner

TRAVEL BOTTLE WITH SLIDE OR ROTATABLE LOCK

This application is a continuation-in-part application of application Ser. No. 15/900,085, filed Feb. 20, 2018, and claims the benefit of priority to U.S. Provisional Patent Application No. 62/686,724, filed Jun. 19, 2018, the entire contents of which are hereby incorporated by reference in their entireties.

FIELD OF THE INVENTION

The present invention relates to the field of bottles which require a secure locking to prevent accidental dispensing of its contents.

BACKGROUND OF THE INVENTION

Oftentimes, when traveling, individuals carry miniaturized versions of full sized liquid content bottles. However, the problem encountered is that the small, travel size bottles often leak or accidentally dispense fluids due to contact with the exterior of the bottle or pressurization of an airline compartment which forces liquids from the bottle. This causes a mess throughout all of the travel contents.

SUMMARY OF THE INVENTION

By the present invention, a bottle includes a secure sealing mechanism. A slide switch plate or rotatable plate maintains closure of the contents of the bottle. This is achieved by securing a dispensing mechanism in a closed, locked position and sealing an outlet so that any liquids are prevented from exiting the bottle.

This is achieved by the use of a bottle cap having a lid that can be opened and closed. When in the closed position the bottle is "locked" by a slide switch plate moved to a locked position. The locked position is indicated by markings on a top body of a cap.

Additional safeguards are implemented so that if the switch plate is in the unlocked position, the lid cannot be closed. This would alert the user that the switch plate has not been transitioned to the locked position and the switch plate should be manually moved to the locked position. Alternatively, a protrusion formed in an underside of the top lid of the container automatically slides the slide switch plate into the locked position or rotates a rotatable plate upon closure of the lid.

When the slide switch is moved to a locked position, the slide switch covers the outlet channel of the bottle. Alternatively, when the rotatable plate is moved to a locked position, the plate covers the outlet channel of the bottle. The lid is then permitted to be closed. This keeps the contents of the bottle from being dispensed under pressure.

Accordingly, it is an object of the present invention to provide a travel bottle with a slide or rotatable switch plate lock.

It is another object of the present invention to provide a travel bottle with a slide or rotatable switch plate lock to move between a locked position and an unlocked position.

It is still yet another object of the present invention to provide a travel bottle with a slide or rotatable switch plate lock to move between a locked position and an unlocked position and preventing a lid of the locking mechanism from being closed in the unlocked position of the slide switch plate lock or automatically moving the slide or rotatable switch plate into the locked position upon closure of the lid.

It is still another object of the present invention to provide a travel bottle with a slide or rotatable switch plate lock to move between a locked position and an unlocked position and preventing a lid of the locking mechanism from being closed in the unlocked position of the slide switch plate lock and allowing the closing of the lid in the locked position of the slide switch plate lock or automatically moving the slide or rotatable switch plate into the locked position upon closure of the lid.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
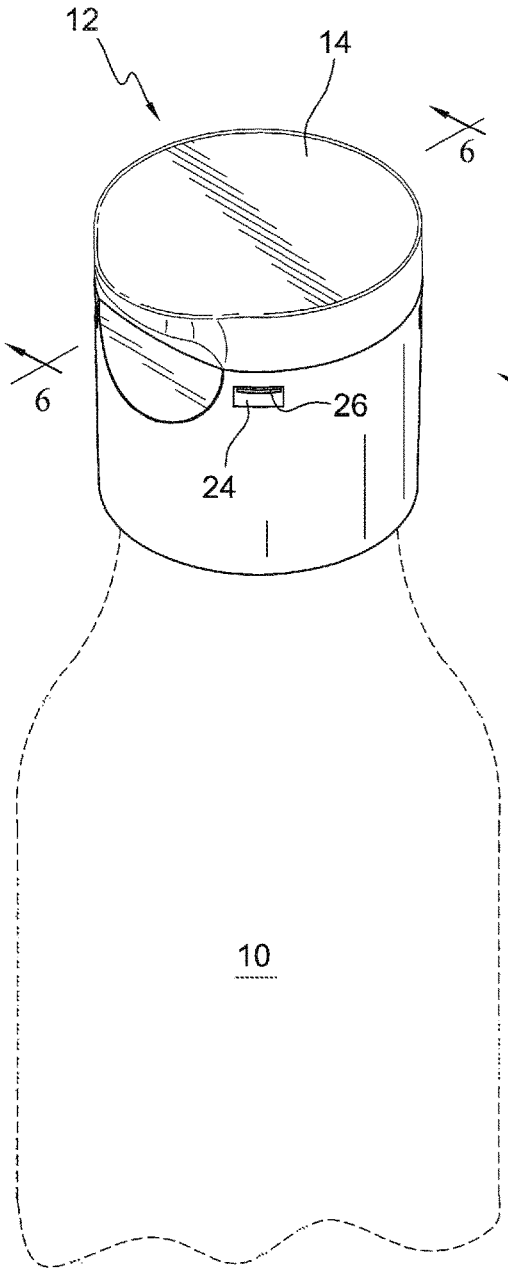
FIG. 1 illustrates a slide switch plate lock of a locking mechanism of the present invention mounted on a bottle in a locked position.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
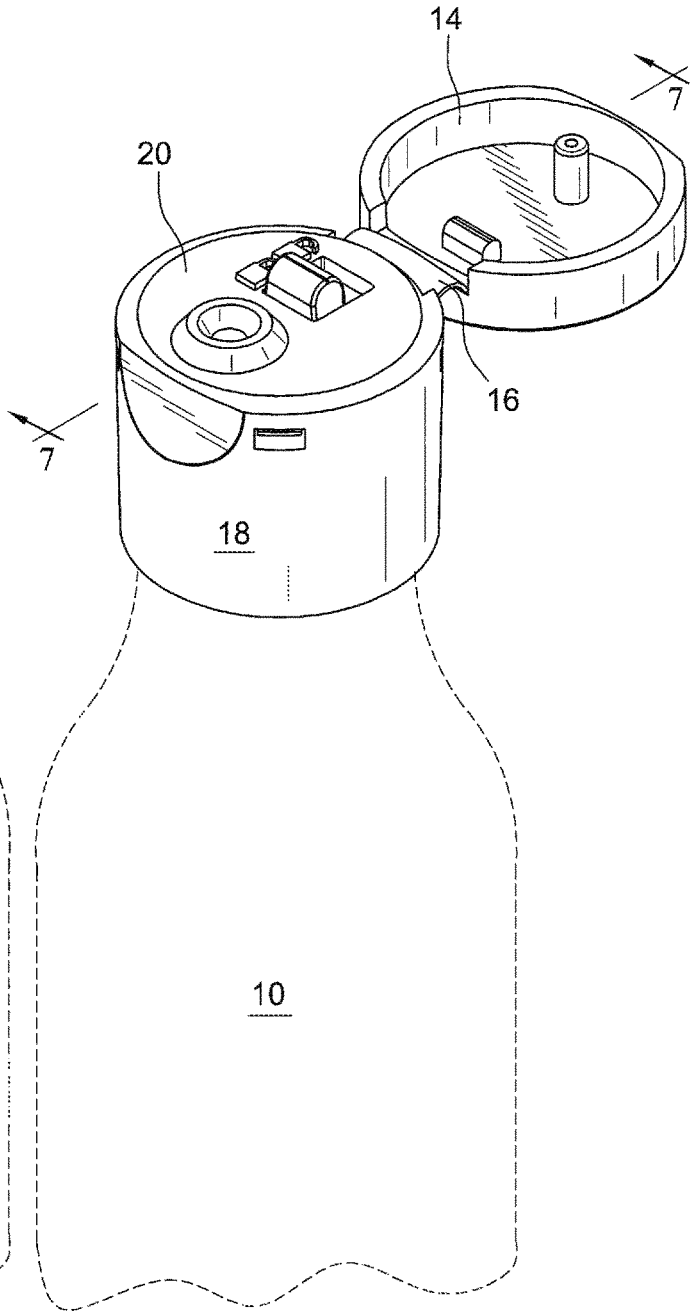
FIG. 2 illustrates an exposed lid of the locking mechanism showing the slide switch plate lock of the present invention mounted on a bottle in the locked position.
Figure 3:
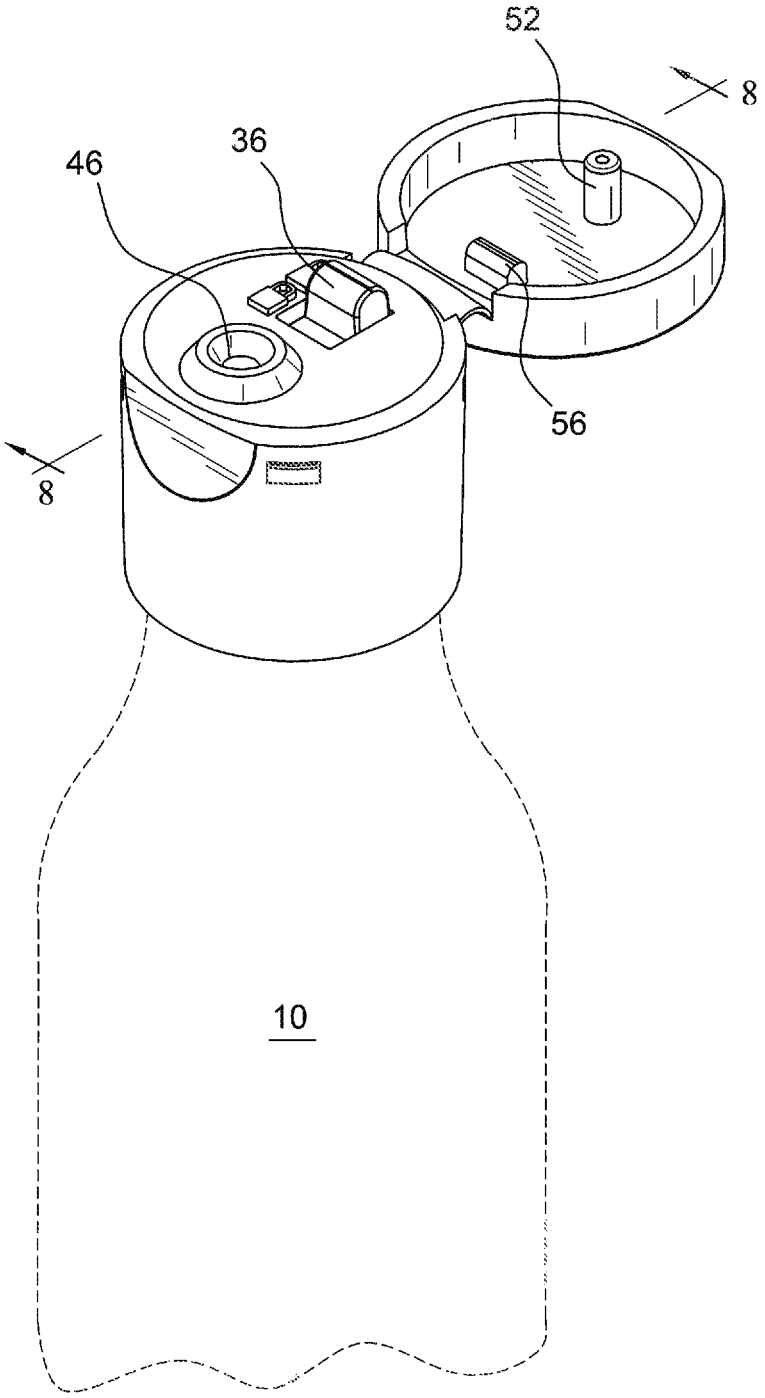
FIG. 3 illustrates the exposed lid of the locking mechanism showing the slide switch plate lock of the present invention mounted on a bottle in the unlocked position.
Figure 5:
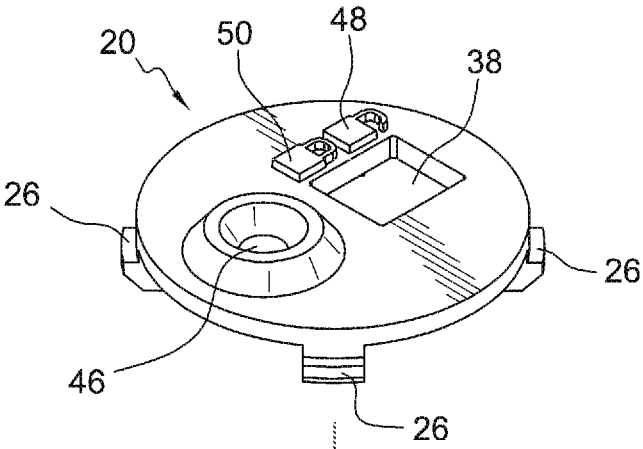
FIG. 5 is a bottom view of the slide switch plate.
Figure 5:
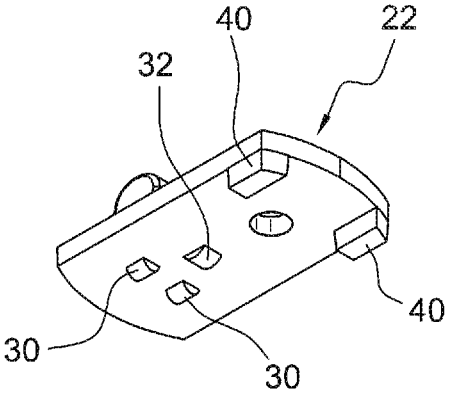

As shown in FIGS. 1 through 3, a travel bottle 10 includes a locking mechanism 12 threadably mounted on the bottle 10. A lid 14 is pivotally mounted by a living hinge 16 onto main body 18. Secured to the main body 18 is a top body 20. Inter-deposed between the main body 18 and the top body 20 is a slide switch plate 22 as best shown in FIGS. 4 and 5.

Figure 4:
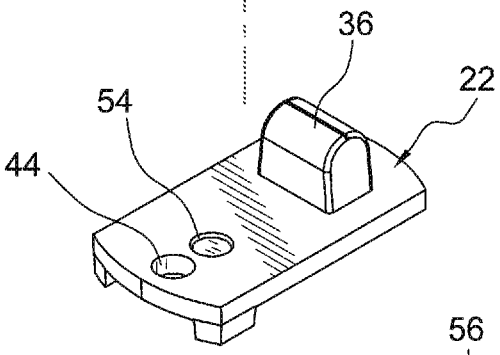
FIG. 4 is an exploded view of the locking mechanism showing a top body and a main body, with a slide switch plate located between the top body and the main body.
Figure 4:
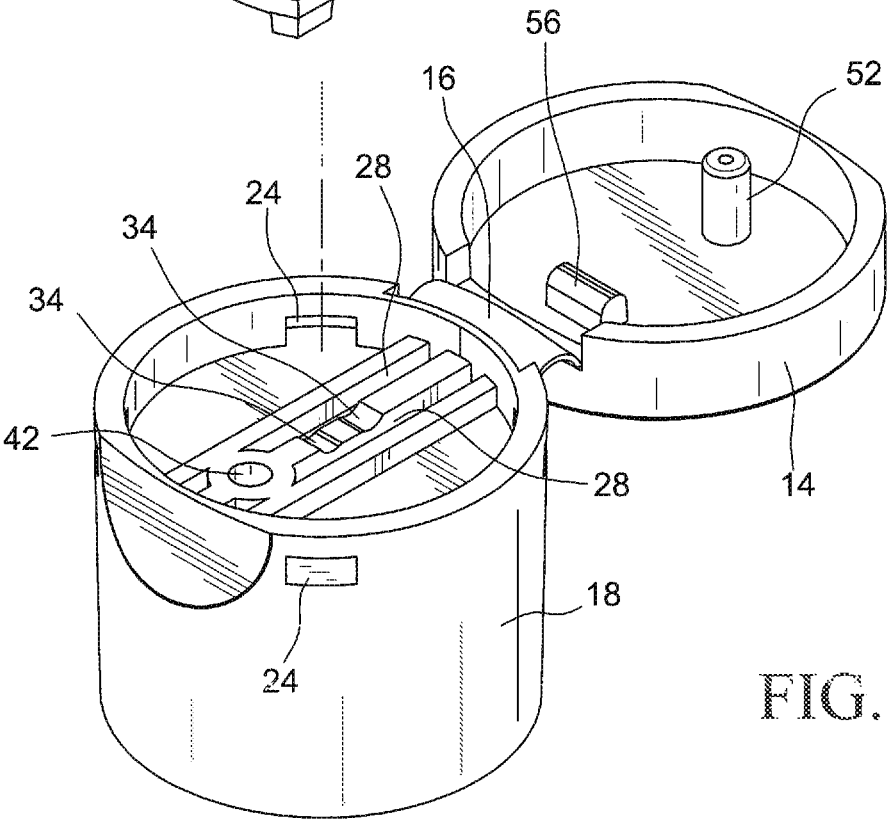

In FIG. 4, the main body 18 includes a plurality of openings 24 spaced about its periphery for receipt of teeth 26 of the top body 20. The teeth 26 fit within the openings 24 to secure the two pieces together with the slide switch plate therebetween.

The main body 18 also includes guide tracks 28 for cooperating with projections 30 located on the underside of the switch plate 22. Extrusions 40 provide glide and guide assistance along the outside of the guide tracks 28 while the projections 30 slide in the guide tracks 28.

Another projection 32 on the underside of the switch plate 22 is shaped to cooperate with a plurality of spaced recesses 34 located between the guide tracks 28 of the main body 18. The projection 32 locks the switch plate in its locked and unlocked positions within the recesses 34. The switch plate 22 is moved by sliding movements of the handle 36 which projects through opening 38 in top body 20.

Passage of fluids from the bottle 10 is achieved by passage through opening 42 in the main body 18. The opening 42 communicates with the interior of the bottle 10. To allow continued passage of the fluids from the bottle, the fluids pass through opening 44 in the switch plate 22 when the switch plate is in the unlocked position. This allows passage of the liquid contents of the bottle 10 to exit through the through hole 46 in the top body 20. The unlocked position of the switch plate 22 is caused by positioning the handle 36 at the rear most portion of opening 38, aligned with unlocked icon 48.

Figure 7:
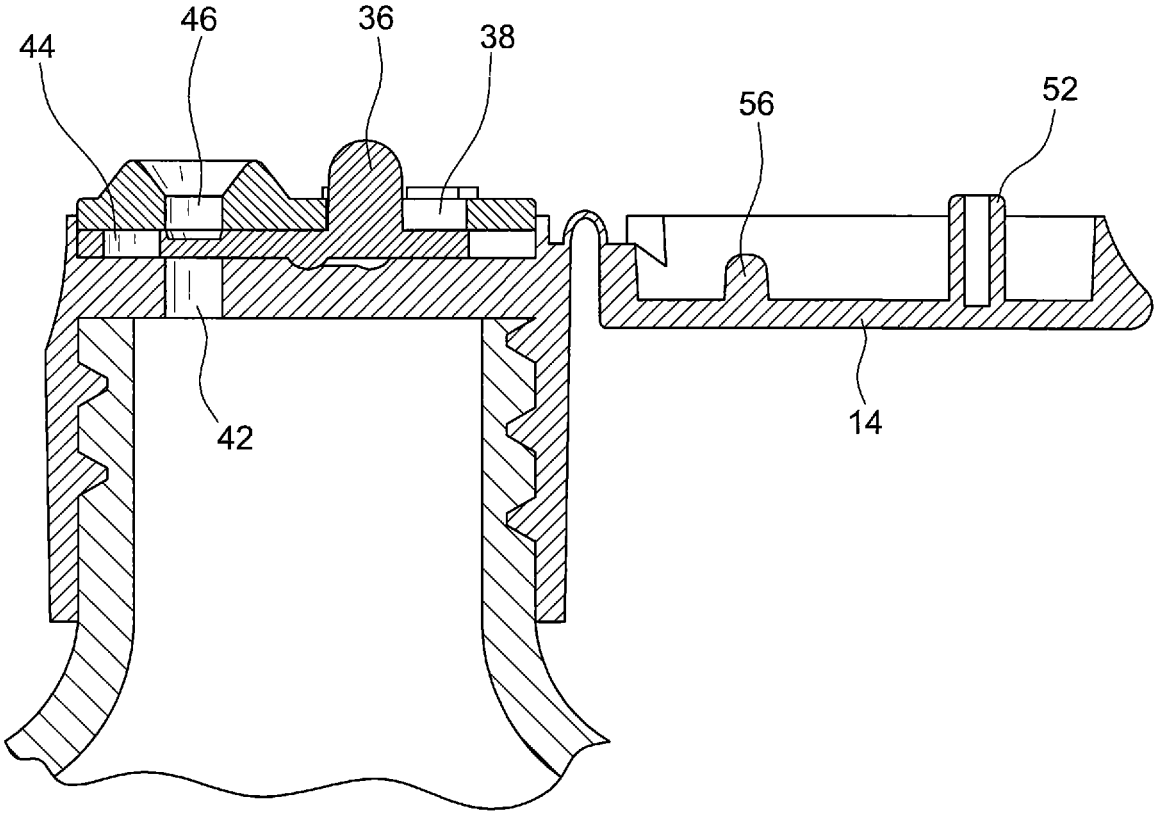
FIG. 7 is a sectional view taken along line 7-7 as shown in FIG. 2.

When the handle 36 is slid forward in the opening 38 to be aligned with locked icon 50, the switch plate covers the opening 42 in the main body 18 as shown in FIG. 7. In the locked position of the switch plate the liquid contents of the bottle 10 are not permitted to exit.

Figure 6:
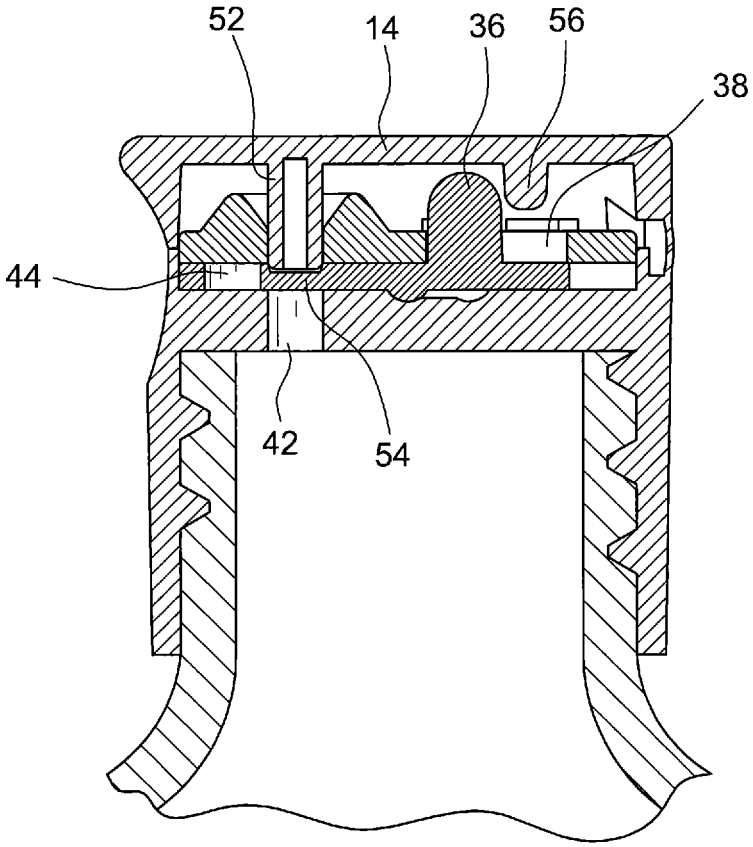
FIG. 6 is a sectional view taken along line 6-6 as shown in FIG. 1.

In the locked position of the switch plate, a plug 52 on the lid 14 is allowed to pass through the opening 46 of the main body 20 and rest within a partial recess 54 of the switch plate 22 as shown in FIG. 6. In this position, with the handle 36 slid forward, the opening 42 is blocked by the switch plate 22 and the plug 52 extends through hole 46 and is seated in recess 54. This acts as a snap feature to keep the lid closed and to keep the fluid from coming out of the bottle.

Another feature assisting in maintaining the lid 14 in a closed, locked position is a projection 56 on the same interior surface of the lid 14 as the plug 52. This projection 56, in the locked position of the switch plate 22 is permitted to be seated behind the handle 36 in the gap formed between the handle 36 and the exposed portion of opening 38, as is also shown in FIG. 6.

Figure 8:
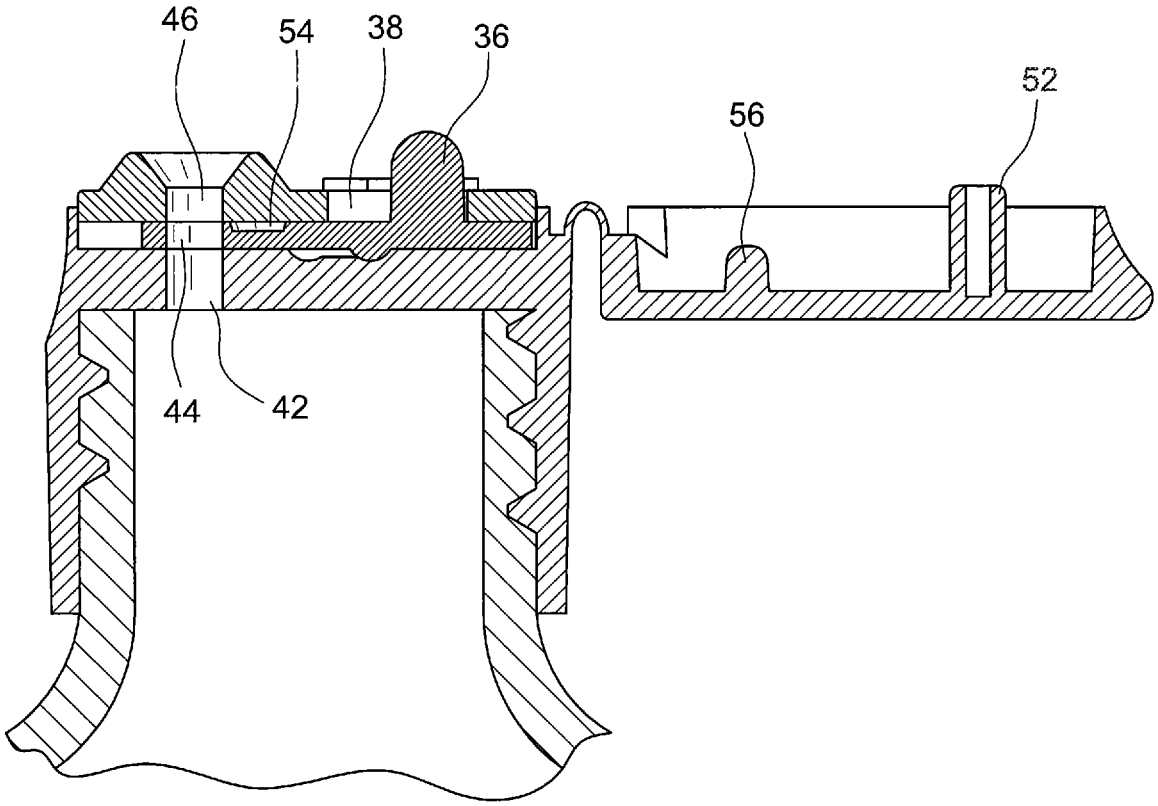
FIG. 8 is a sectional view taken along line 8-8 as shown in FIG. 3.

When the switch plate 22 is in the unlocked position, as shown in FIG. 8, the lid 14 is not permitted to close because the projection 56 engage with the top of the handle 36. This is a safeguard against closing the lid 14 while the switch plate is in the unlocked position.

Figures 9, 10:
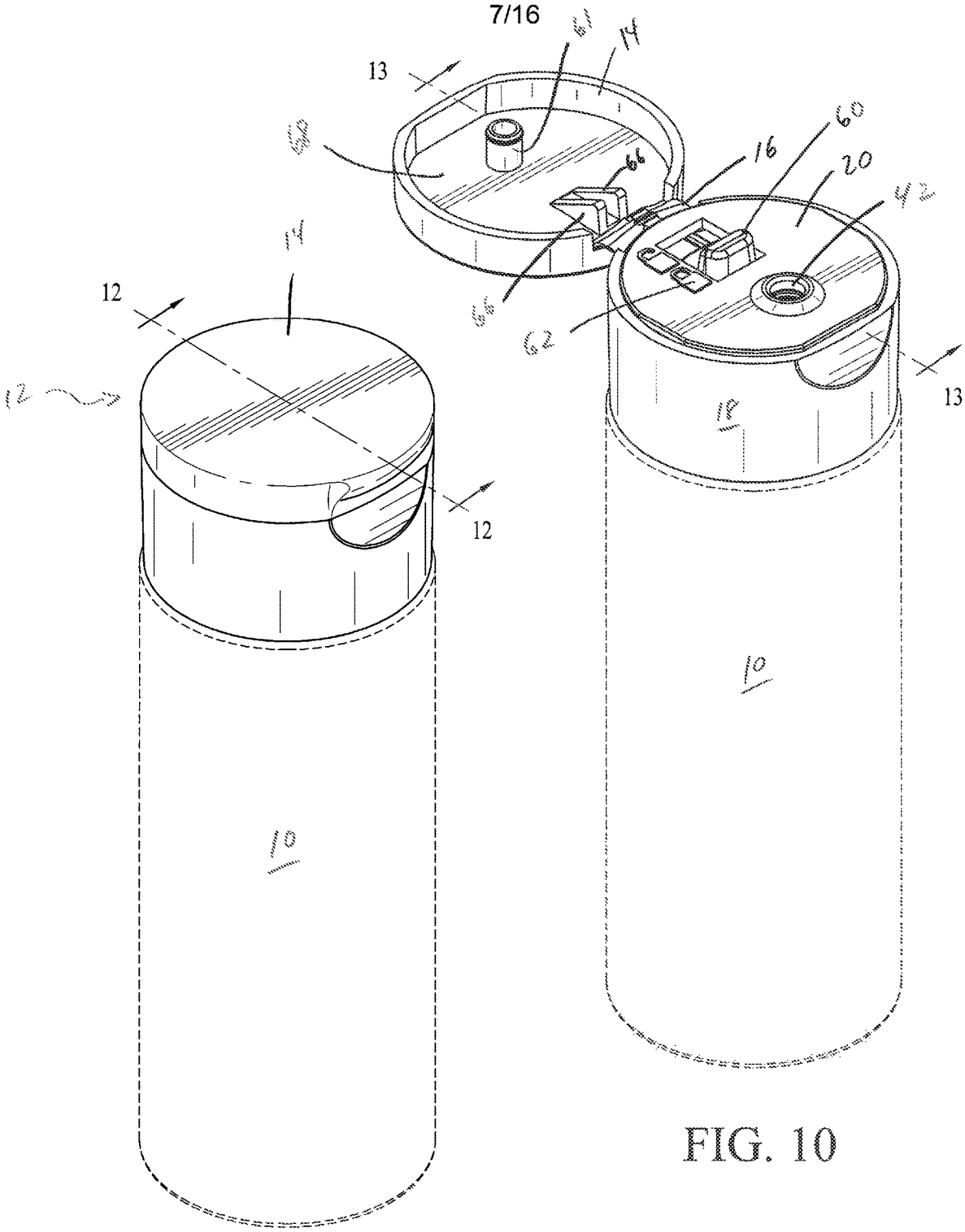
FIG. 9 illustrates an alternate embodiment of a slide switch plate lock of a locking mechanism of the present invention mounted on a bottle in a locked position.
FIG. 10 illustrates an exposed lid of the locking mechanism showing the slide switch plate lock of the present invention mounted on a bottle in the locked position.
Figure 11:
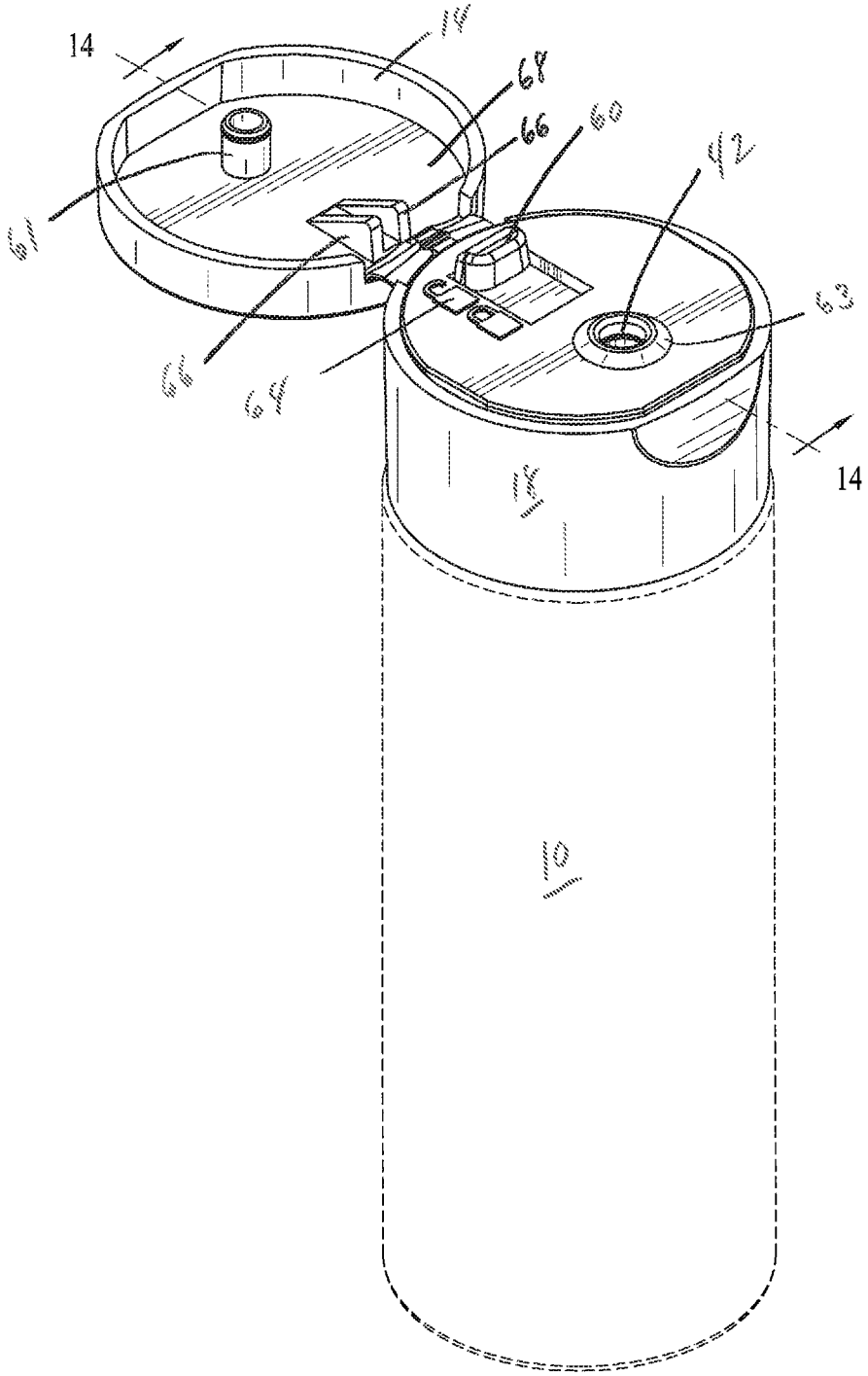
FIG. 11 illustrates the exposed lid of the locking mechanism showing the slide switch plate lock of the present invention mounted on a bottle in the unlocked position.

As shown in FIGS. 9 through 11, a travel bottle 10 includes a locking mechanism 12 threadably mounted on the top of the bottle 10. A lid 14 is pivotally mounted by a living hinge 16 onto main body 18 of the locking mechanism 12. Secured to the main body 18 is a top body 20. Inter-deposed between the main body 18 and the top body 20 is a slide switch plate as described with reference to FIGS. 4 and 5.

In the embodiment of FIGS. 9 through 14, an alternative arrangement of the mechanism for closing off the contents of the bottle 10 is disclosed. Passage of fluids from the bottle 10 is achieved by passage through opening 46 in the main body 18. Opening 42 communicates with the interior of the bottle 10 through passageway 46. To allow continued passage of the fluids from the bottle, the fluids pass through an opening 44 in the switch plate when the switch plate is in the unlocked position as shown in FIG. 11.

In FIG. 10, the handle 60 is shown in the locked position as identified by icon 62. In FIG. 11, the handle 60 is shown in the unlocked position as identified by icon 64. While the handle 60 is moved into the unlocked position shown in FIG. 11 by a manual movement of the handle 60, the handle is automatically returned to the locked position shown in FIG. 10 by the closure of the lid 14. This is accomplished by ramped extrusions 66 projecting from the underside 68 of the lid 14.

Figure 12:
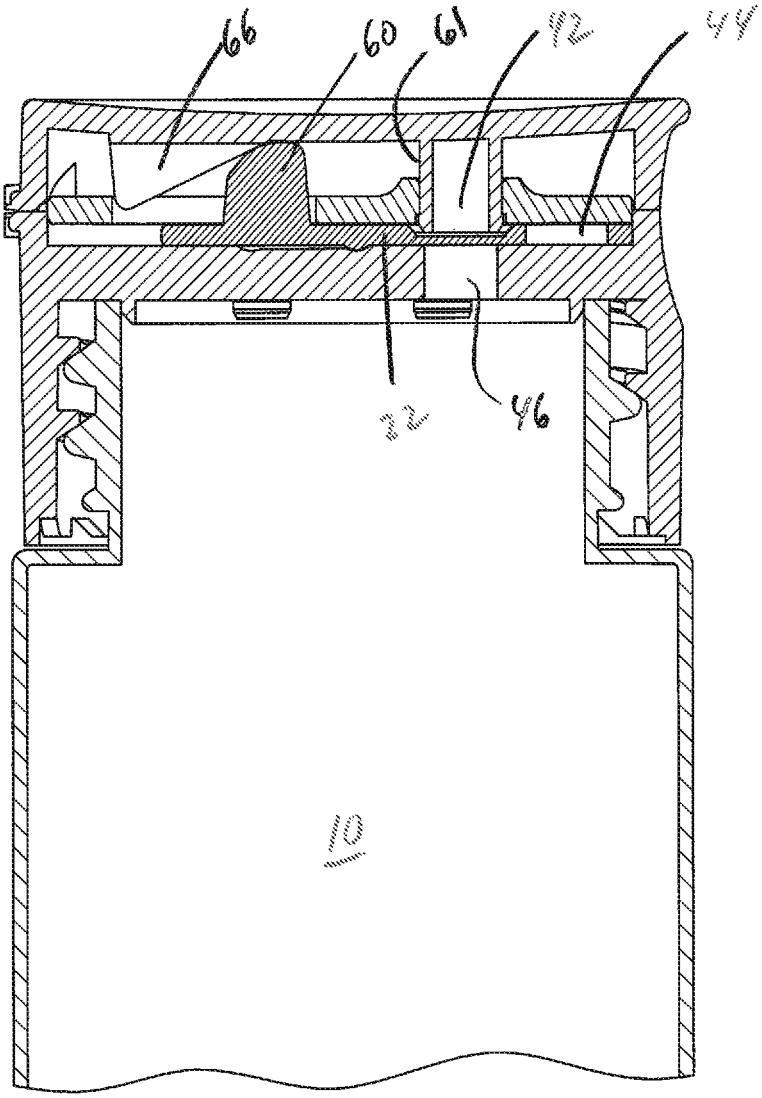
FIG. 12 is a cross sectional view taken along line 12-12 of FIG. 9.
Figure 13:
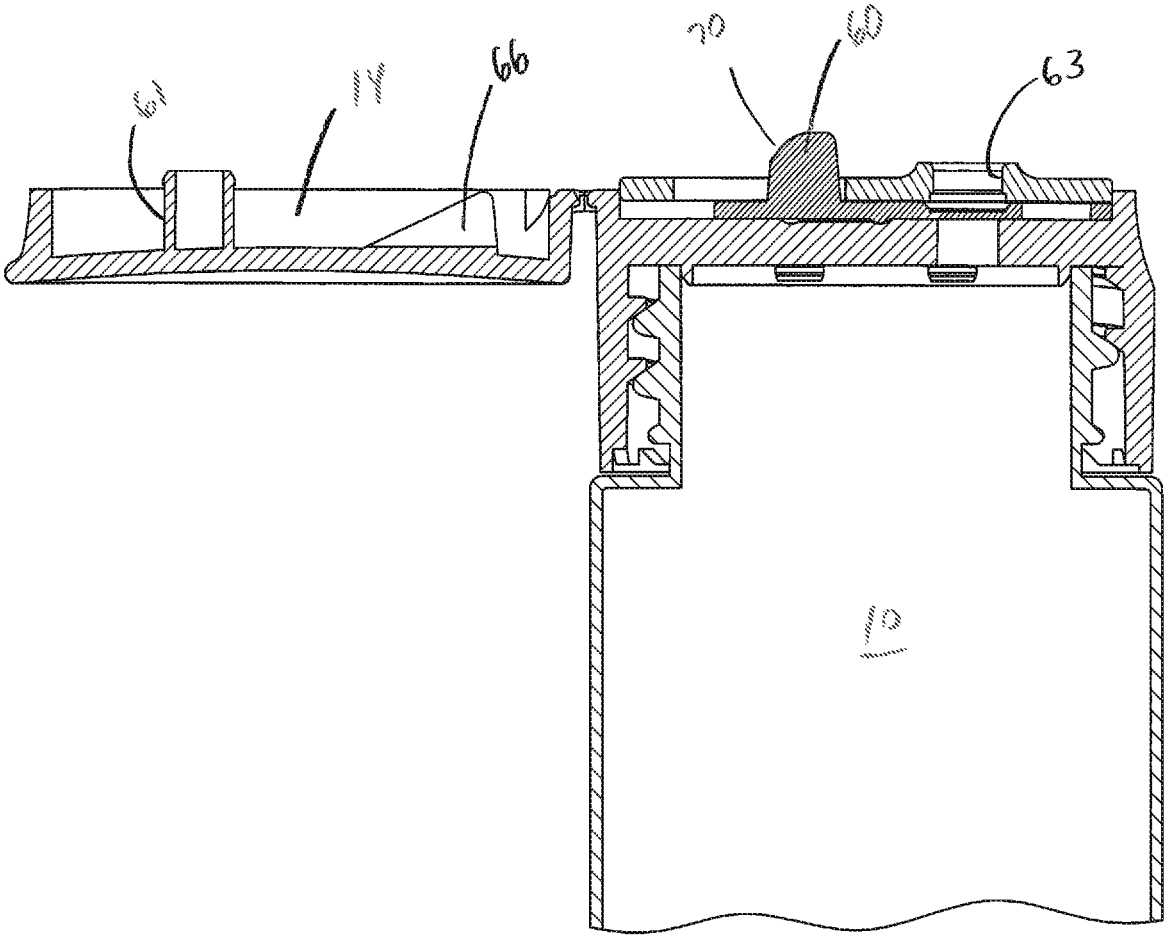
FIG. 13 is a cross sectional view taken along line 13-13 of FIG. 10.
Figure 14:
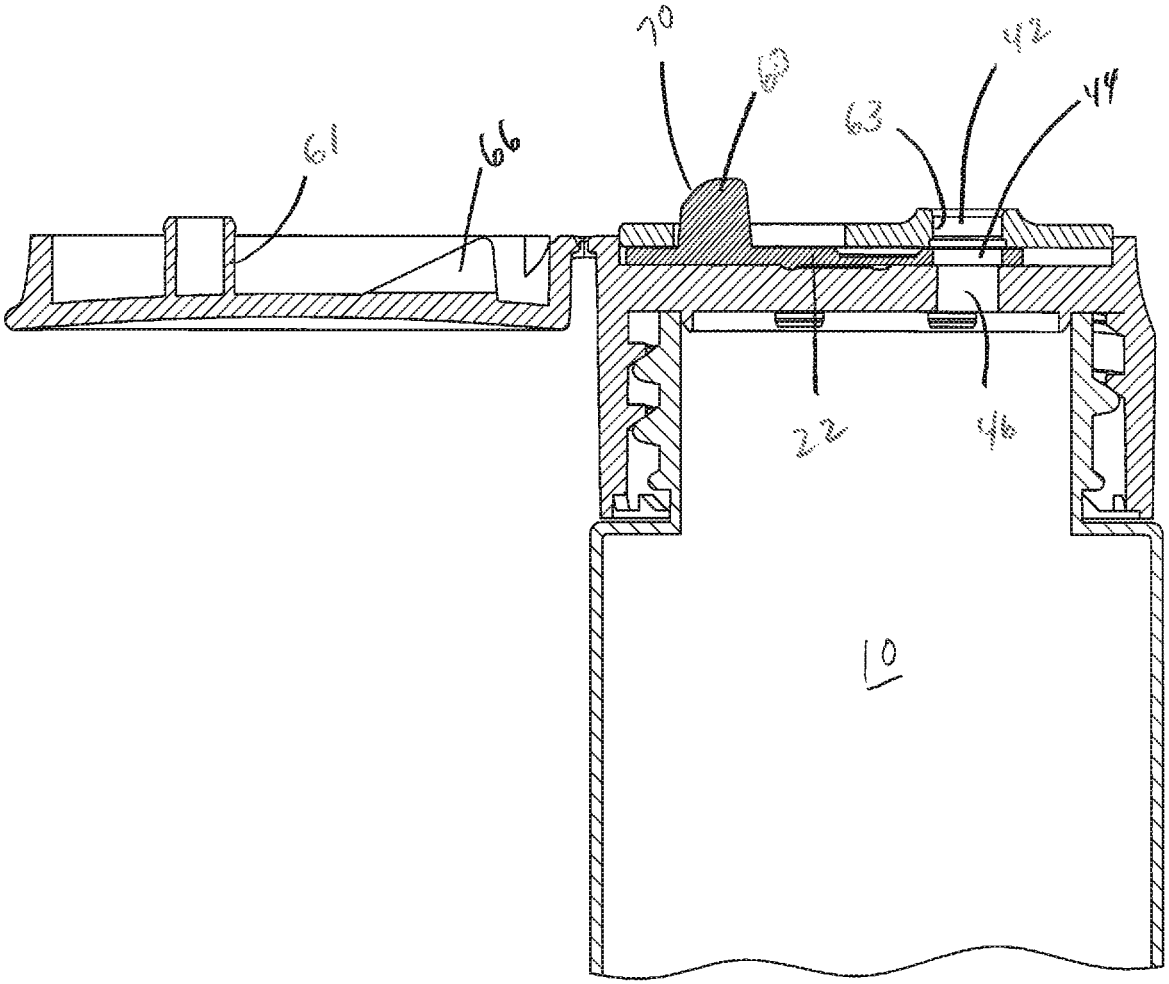
FIG. 14 is a cross sectional view taken along line 14-14 of FIG. 11.
Figure 15:
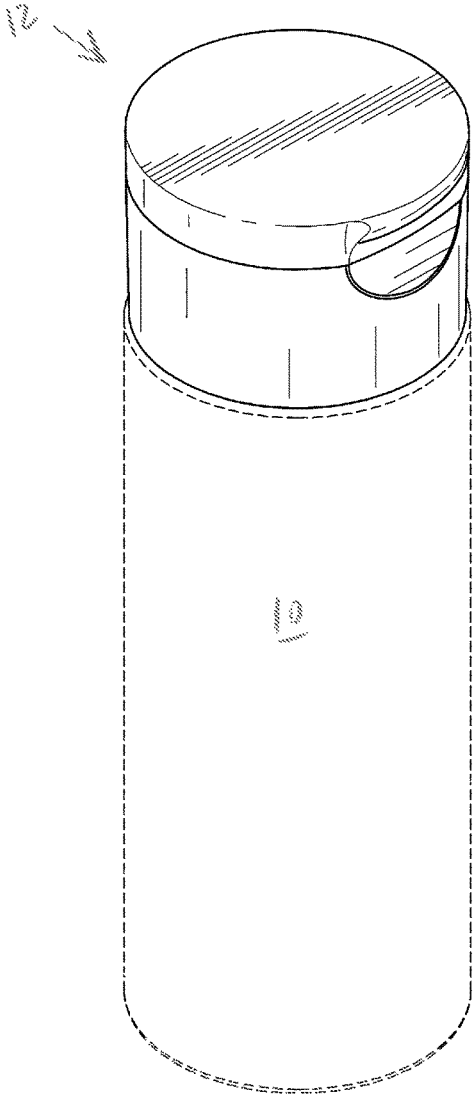
FIG. 15 illustrates another alternate embodiment of a rotatable plate lock of a locking mechanism of the present invention mounted on a bottle in a locked position.
Figure 16:
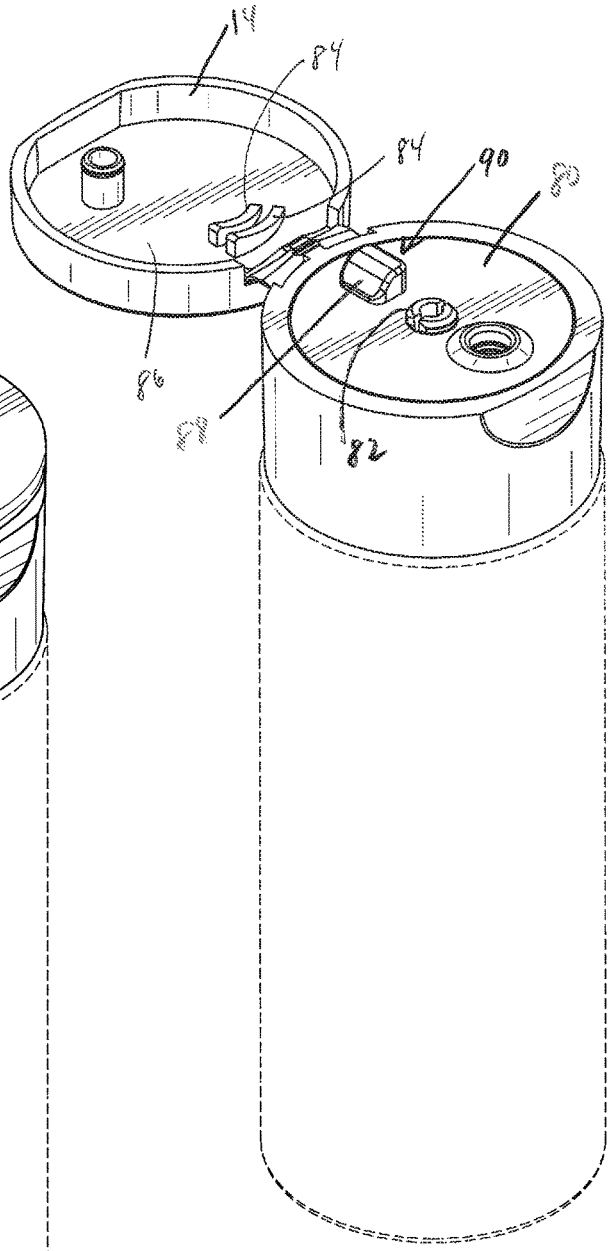
FIG. 16 illustrates an exposed lid of the locking mechanism showing the rotatable plate lock of the present invention mounted on a bottle in the locked position.

As shown in sectional views in FIGS. 12 through 14, ramped extrusions 66 engage the handle 60 at an inclined contact surface 70 when it is desired to lock the contents of the bottle 10, as initially shown in the open position in FIG. 14. The continued closure of the lid 14 with the ramped extrusions 66 engaging the inclined contact surface 70, forces the handle 60 forward until terminating in the position shown in FIG. 12. In this position, slide plate 22 is moved forwardly so as to seal opening 46 in the main body. The opening 42 is prevented from communicating with the opening 44 in the switch plate 22 to prevent exit of fluids through the through hole 46. Extrusion 61 is then locked in place in recess 63 formed around opening 42.

After opening of the lid 14 as shown in FIG. 13, the handle 60 is manually engaged and moved to the position shown in FIG. 14 to allow passage there through of the contents of the bottle 10 by passage through openings 46, 44 and 42. Therefore, by the ramped extrusions contacting the inclined surface of the handle 60, the automatic sealing of the contents of the bottle 10 is achieved by a closure of the lid 14.

Another alternate embodiment is disclosed in FIGS. 15 through 23. In this embodiment, similar features of the preceding figures are employed. However, in this embodiment, the locking mechanisms 12 mounted on bottle 10 makes use of a rotatable plate 80 which is rotatably mounted about center pin 82 as a rotating locking mechanism.

Figure 17:
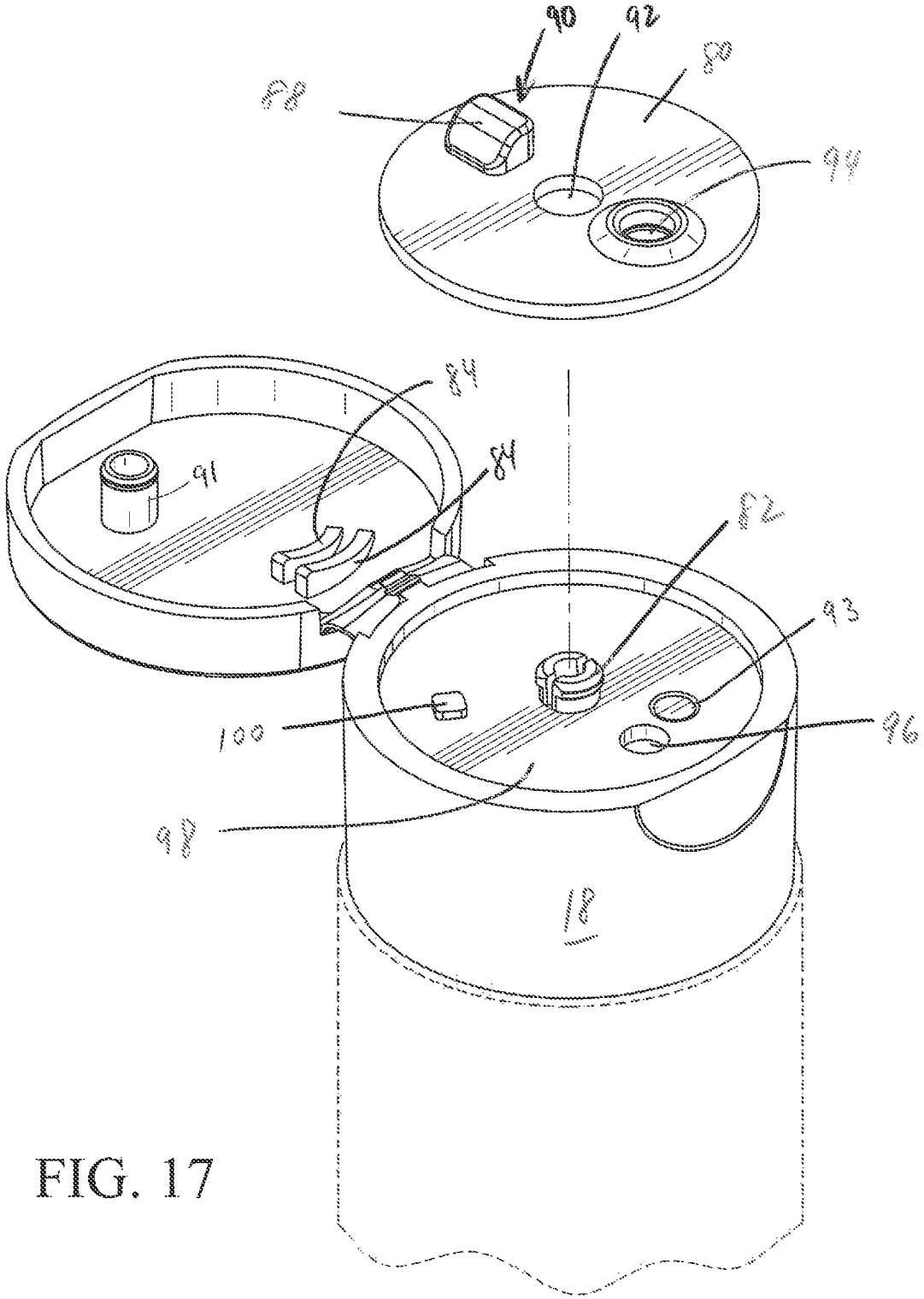
FIG. 17 illustrates the exposed lid of the locking mechanism showing the rotatable plate lock of the present invention mounted on a bottle in the unlocked position.

In this embodiment, ramped extrusions 84 project from the underside 86 of lid 14 and follow the curvature of the periphery of the lid 14 for engagement with an inclined exterior surface 88 of handle 90. As shown in FIG. 17, rotatable plate 80 includes a central opening 92 for engagement with center pin 82. The plate 80 is rotated about center pin 82 to cause alignment and misalignments of an opening 94 in the plate 80 with an opening 96 of a top plate 98 of the main body 18.

A square projection 100 rides within a groove 102 located on an un underside of the plate 80 for alignment purposes and limits an amount of rotation of the plate 80. A detent recess 93 is aligned with a small extrusion on the bottom of plate 80 for snapping of the plate into the recess 93 to provide the user with feedback when the lid is opened or closed.

Figure 18:
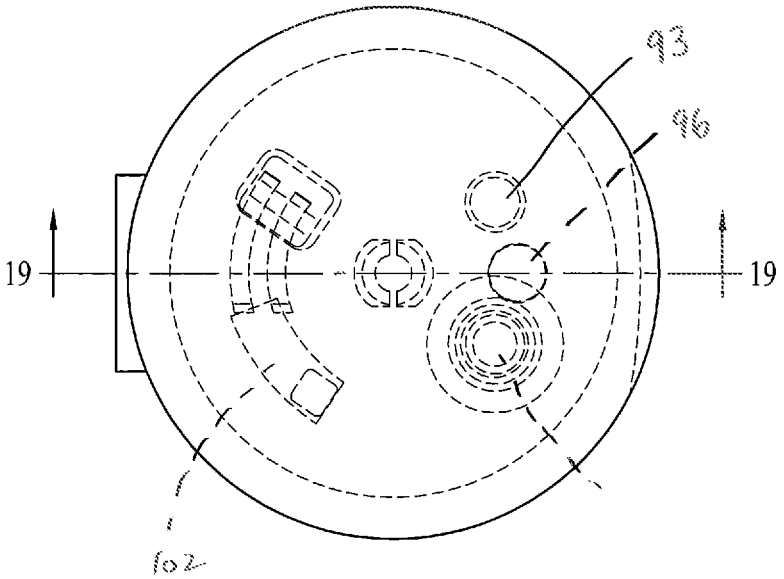
FIG. 18 is a top view of the closed lid of the bottle.
Figure 19:
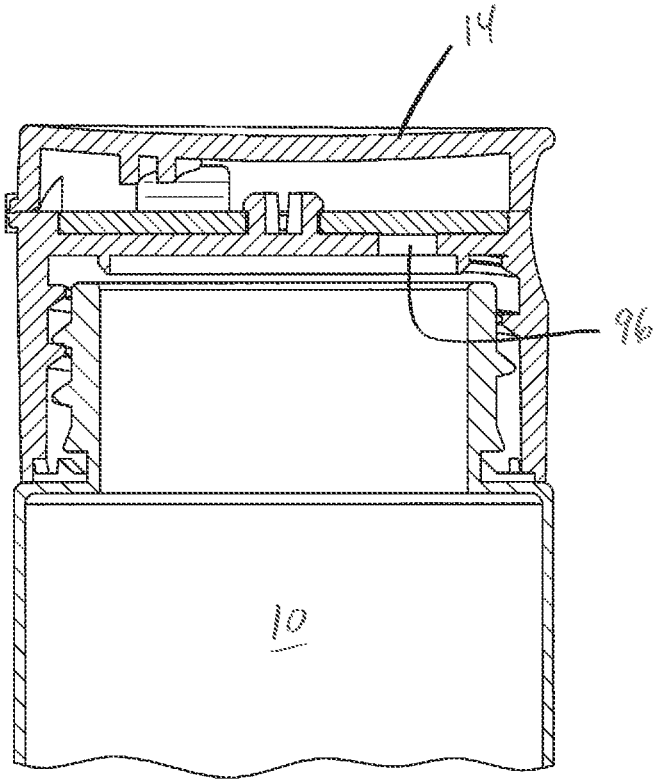
FIG. 19 is a cross sectional view taken along line 19-19 of FIG. 18.

As shown in FIGS. 18 and 19, when the lid 14 is being moved to be closed, the exposed ramp surface of the ramped extrusions 84 engages with the inclined surface 88 of the handle 90. Inclined surface 88 has a rounded edge transitioning to an angled surface where the inclined surface contacts the inclined ramps to keep the handle from binding up. This causes clockwise rotation of the plate 80 around center pin 82 for approximately 35° such that access through opening 96 to the contents of the bottle 10 is blocked by the plate 80.

Figure 20:
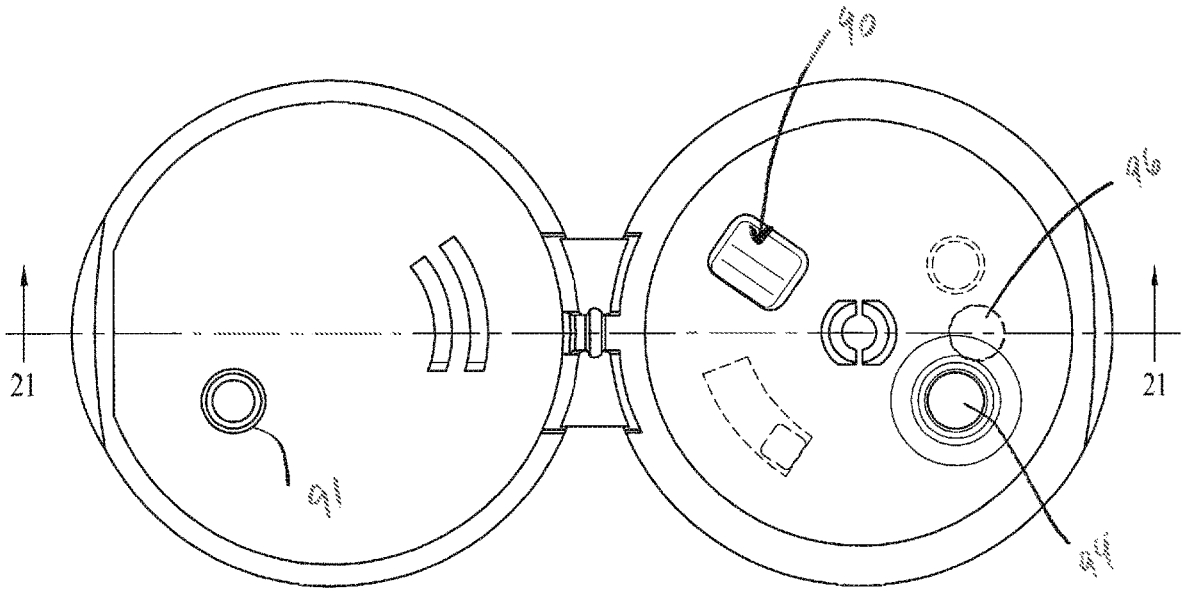
FIG. 20 is a top view of the open lid of the bottle in the locked position.
Figure 21:
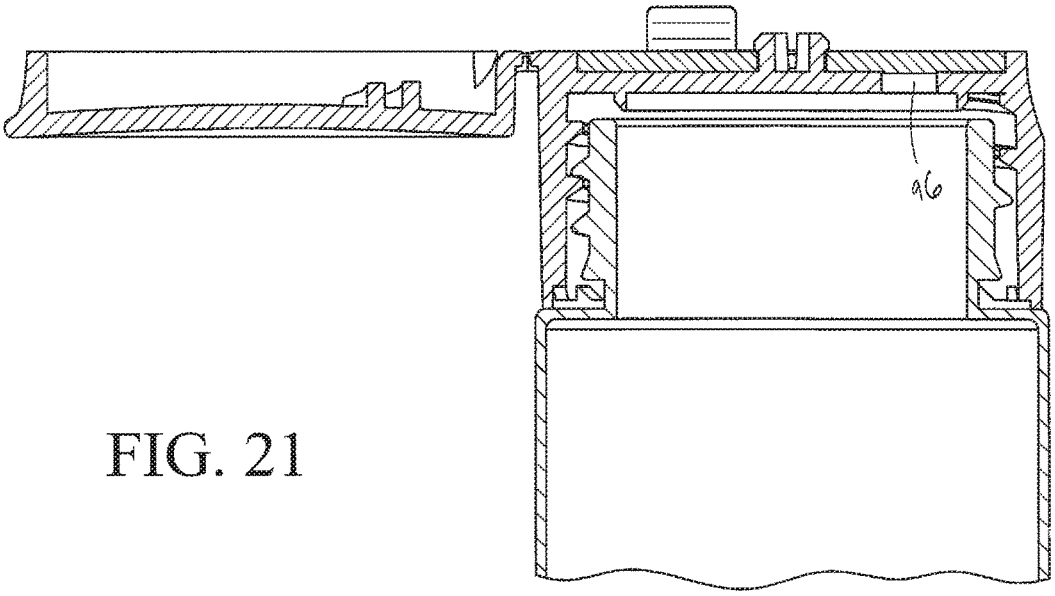
FIG. 21 is a cross sectional view taken along line 21-21 of FIG. 20.
Figure 22:
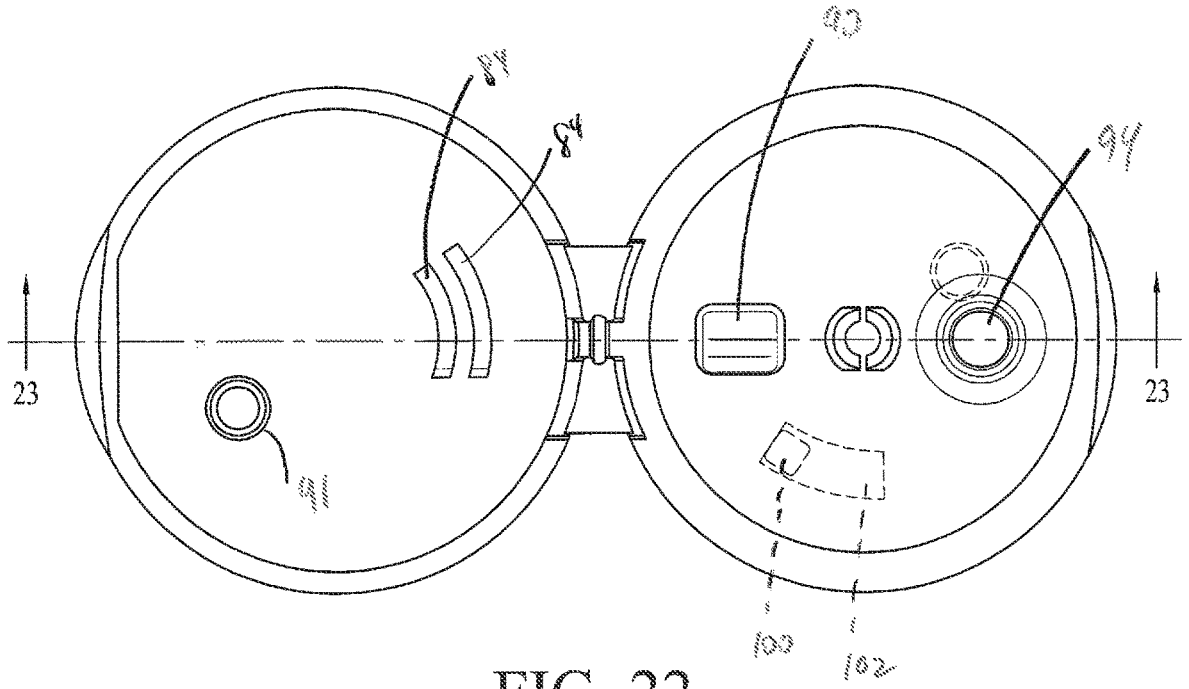
FIG. 22 is a top view of the open lid of the bottle in the unlocked position.
Figure 23:
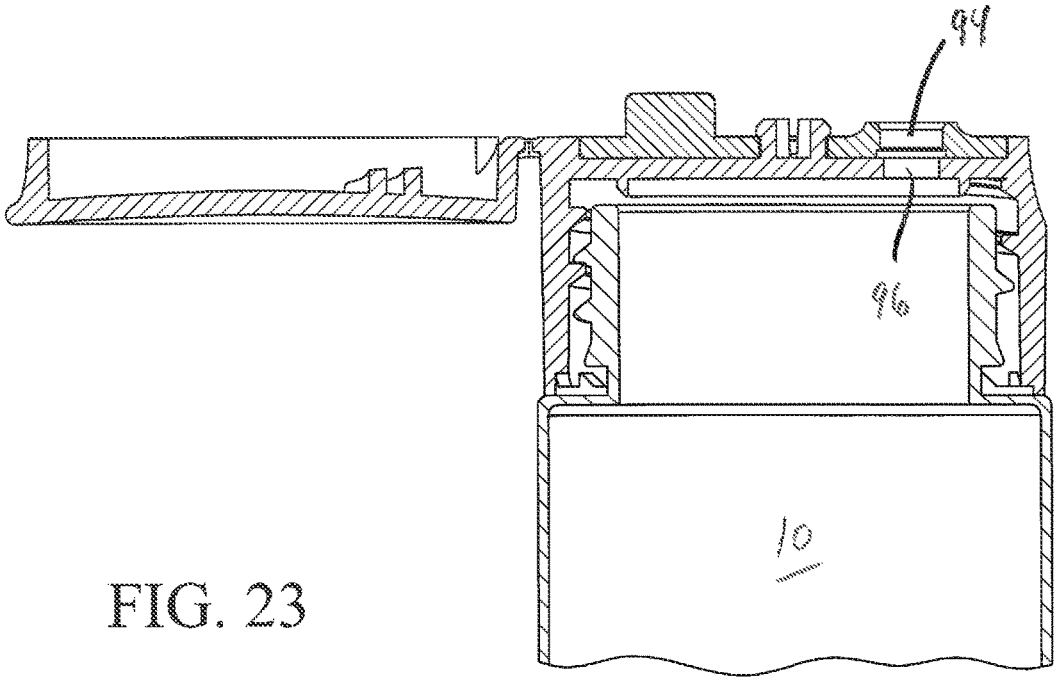
FIG. 23 is a cross sectional view taken along line 23-23 of FIG. 22.

When the lid is opened, as shown in FIG. 20, the handle 90 must be manually moved so as to move the handle into the position shown in FIG. 22 allow alignment of the passage 94 with the passage 96 to allow egress of the contents of the bottle 10 through the locking mechanism 12. In the closed position of the lid, after movement of plate 80, plug extrusion 91 is seated with a friction fit snap in opening 94. This helps secure the closed position of the lid 14 and also prevents the plate 80 from rotating.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A cap of a dispensing bottle, said cap comprising
- a main body having a lid, said lid being movable into an open position and a closed position,
- a top body secured to said main body, and
- a switch plate secured between said main body and said top body, said switch plate including a handle slidably moving said switch plate between a locked position and an unlocked position, said switch plate being automatically moved from said unlocked position into said locked position by said lid being moved into said closed position,
- wherein said main body, said top body and said switch plate each include a passageway, said passageway of said main body, said passageway of said top body and said passageway of said switch plate are aligned for passage therethrough of a liquid when said switch plate is in said unlocked position.

2. The cap of a dispensing bottle according to claim 1, wherein said lid includes a protrusion on an underside of said lid, said lid is pivotally mounted on said main body to close said passageway of said top body when said handle is engaged by said protrusion during movement of said lid from said open position into said closed position.

3. The cap of a dispensing bottle according to claim 2, wherein said lid includes a plug sized to fit in said passageway of said top body.

4. The cap of a dispensing bottle according to claim 3, wherein said switch plate includes a recess for the receipt of said plug when said lid is closed and said switch plate is in said locked position with said plug extending through said passageway of said top body.

5. The cap of a dispensing bottle according to claim 2, wherein said protrusion includes a ramped surface.

6. The cap of a dispensing bottle according to claim 5, wherein said protrusion contacts said handle by said ramped surface and allows said lid to be closed when said switch plate is moved from said unlocked position into said locked position.

7. The cap of a dispensing bottle according to claim 1, wherein said passageway of said main body and said passageway of said top body are blocked by said switch plate when said switch plate is in said locked position.

8. A cap of a dispensing bottle, said cap comprising
- a main body having a lid, said lid being movable into an open position and a closed position,
- a top body secured to said main body, and
- a switch plate secured between said main body and said top body, said switch plate including a handle slidably moving said switch plate between a locked position and an unlocked position, said switch plate being automatically moved from said unlocked position into said locked position by said lid being moved into said closed position, said handle projecting through an opening of said top body.

9. The cap of a dispensing bottle according to claim 1, wherein said switch plate is manually movable from the locked position to the unlocked position after moving of said lid from said closed position to said open position.

10. A cap of a dispensing bottle, said cap comprising
- a main body having a lid, said lid being movable into an open position and a closed position,
- a plate rotatably secured to said main body, and
- said plate including a handle moving said plate between a locked position and an unlocked position, said lid being movable into said closed position from said open position and automatically moving said plate from said unlocked position to said locked position.

11. The cap of a dispensing bottle according to claim 10, wherein said main body, said top body and said plate each including a passageway, said passageway of said main body and said passageway of said plate are aligned for passageway there through of a liquid when said plate is in said unlocked position.

12. The cap of a dispensing bottle according to claim 11, wherein said lid includes a protrusion on an underside of said lid, said lid is pivotally mounted on said main body to close said passageway of said main body when said handle is engaged by said protrusion during movement of said lid from said open position into said closed position.

13. The cap of a dispensing bottle according to claim 12, wherein said lid includes a plug sized to fit in said passageway of said main body.

14. The cap of a dispensing bottle according to claim 13, wherein said plate includes a recess for the receipt of said plug when said lid is closed and said plate is in said locked position with said plug extending into said passageway of said main body.

15. The cap of a dispensing bottle according to claim 10, wherein said lid includes a projection, said projection engages said handle to rotate said plate into said locked position when the lid is moved from said open position to said closed position.

16. The cap of a dispensing bottle according to claim 15, wherein said projection contacts said handle and allows said lid to be closed while said plate is moved from said unlocked position into said locked position.

17. The cap of a dispensing bottle according to claim 11, wherein said passageway of said main body is blocked by said plate when said plate is in said locked position.

18. The cap of a dispensing bottle according to claim 10, wherein said handle is projected above said plate.

19. The cap of a dispensing bottle according to claim 10, wherein said plate engages with a pin of said main body for rotation of said plate and holding said plate in the locked position or the unlocked position.

* * * * *